United States Patent [19]

Wolters et al.

[11] 4,084,334

[45] Apr. 18, 1978

[54] SUCTION DREDGE WITH SWELL COMPENSATING LADDER MOUNT

[75] Inventors: Tjako Aaldrik Wolters, Zeist; Jan de Koning, Amsterdam, both of Netherlands

[73] Assignees: Ballast-Nedam Groep N.V., Amstelveen; Amsterdamse Ballast Bagger, Nieuwegein, both of Netherlands

[21] Appl. No.: 674,446

[22] Filed: Apr. 7, 1976

[30] Foreign Application Priority Data

Apr. 15, 1975 Netherlands ..... 7504487

[51] Int. Cl.[2] ..... E02F 3/90

[52] U.S. Cl. ..... 37/67; 37/72

[58] Field of Search ..... 37/67, 64–66, 37/58, 61–63, 72, 189, 190; 212/3

[56] References Cited

U.S. PATENT DOCUMENTS

| | | | |
|---|---|---|---|
| 925,079 | 6/1909 | Carlesimo | 37/58 |
| 2,492,159 | 12/1949 | Lehman | 37/190 |
| 2,933,837 | 4/1960 | Nelson | 37/67 X |
| 3,462,963 | 8/1969 | Moore | 37/58 X |
| 3,579,872 | 5/1971 | Jantzen | 37/72 X |
| 3,603,643 | 9/1971 | Hirota et al. | 37/67 UX |
| 3,777,375 | 12/1973 | Smith | 37/67 |
| 3,777,376 | 12/1973 | Turner et al. | 37/67 |
| 3,797,139 | 3/1974 | Larralde | 37/67 |
| 3,821,859 | 7/1974 | McWalters | 37/67 |

FOREIGN PATENT DOCUMENTS

| | | | |
|---|---|---|---|
| 2,303,850 | 8/1973 | Germany | 37/72 |

OTHER PUBLICATIONS

Dredging Progress, vol. X, No. 1, 2nd Quarter 1967, An Ellicott Machine Corporation Publication.

*Primary Examiner*—Clifford D. Crowder
*Attorney, Agent, or Firm*—Snyder, Brown & Ramik

[57] ABSTRACT

A cutting-head suction-dredger comprises a floating body, a ladder and a cutting-head carried by the lower end of the ladder. The ladder supports against the floating body through a rail guide which is adapted to tilt with respect to the floating body and which extends in the direction of length of the ladder. This prevents that the engagement of the cutting-head upon the ground is disturbed during heaving movements of the floating body.

14 Claims, 10 Drawing Figures

Figure 1:
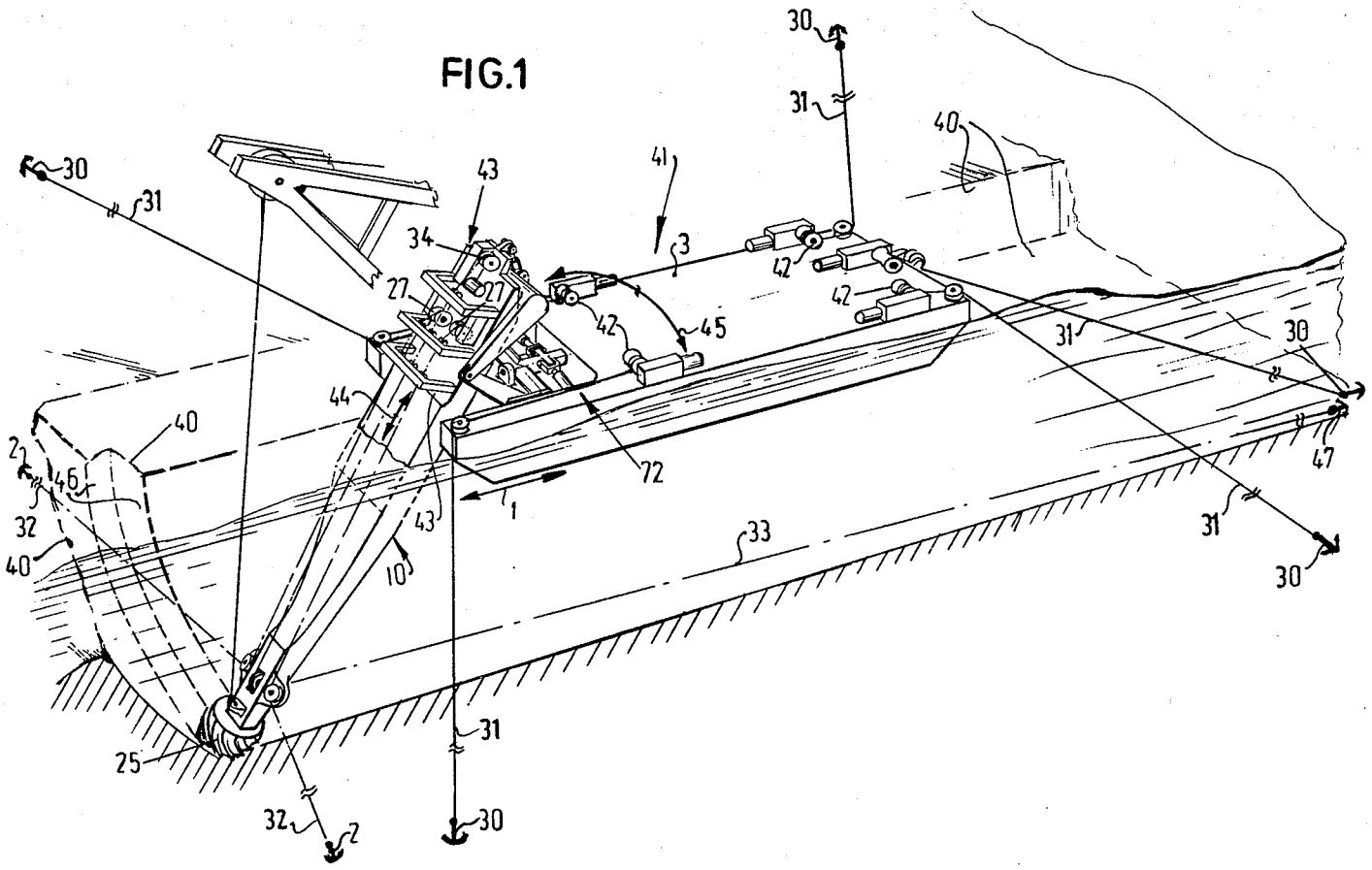

FIG.5
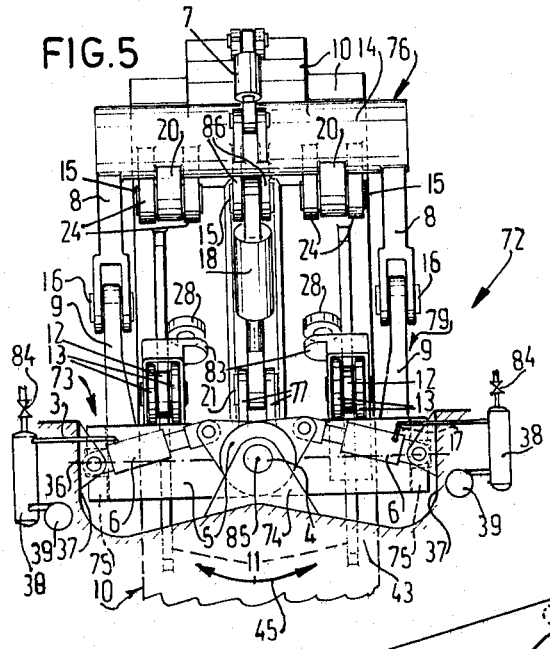
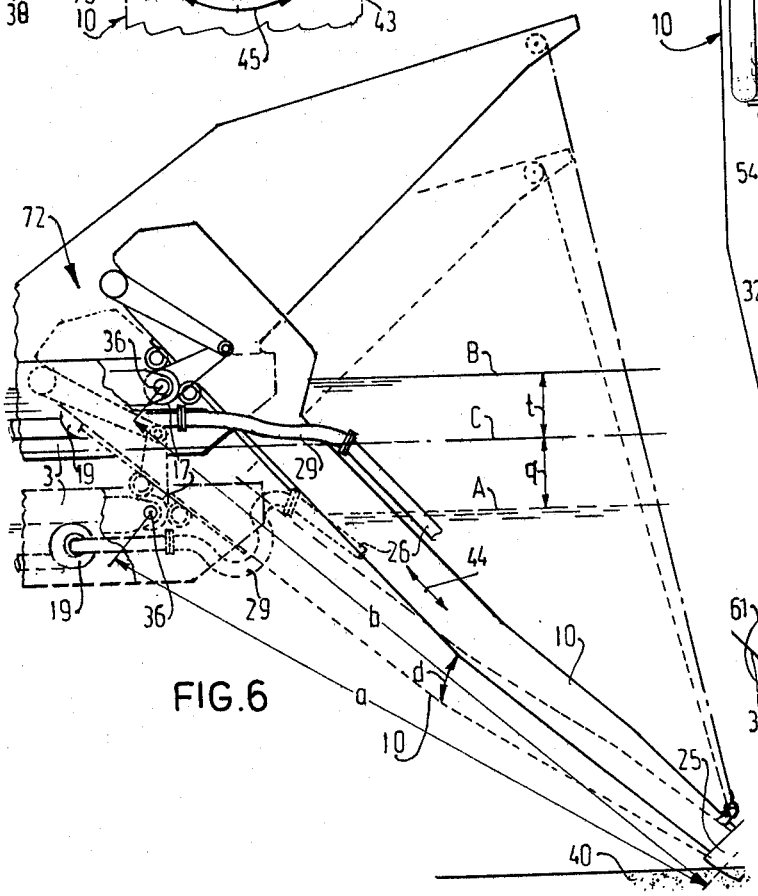
FIG.6
FIG.7
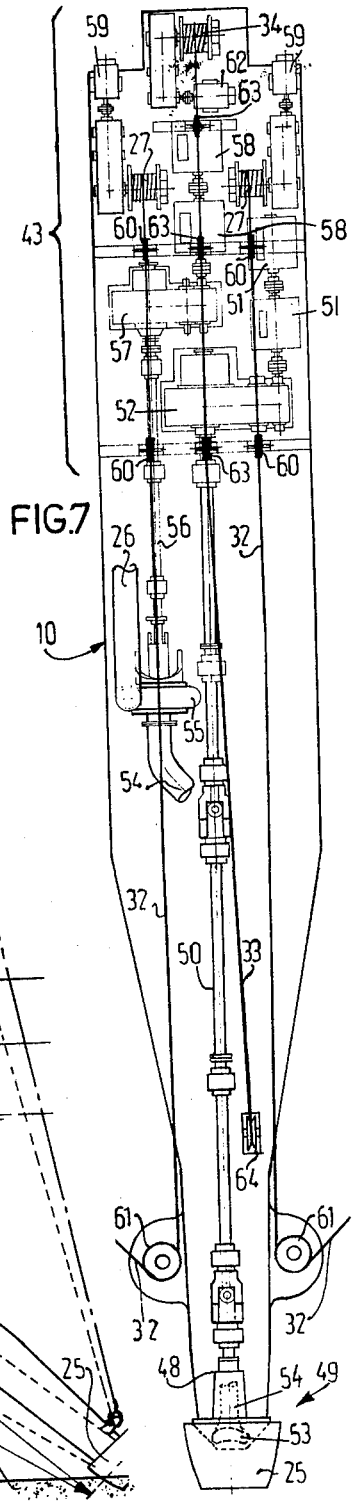

SUCTION DREDGE WITH SWELL COMPENSATING LADDER MOUNT

The invention relates to a cutting-head suction-dredger comprising a floating body, anchoring means for anchoring the floating body, a ladder connected by bearing means with the floating body and being rigid from its top end above the water to the lower end and a cutting head rotatably driven and journalled at the lower end of the ladder.

A cutting-head suction-dredger of the kind set forth is known. In quiet water said conventional cutting-head suction-dredger permits of operating effectively because under such conditions the cutting head bears with a substantially constant pressure depending upon the weight of the ladder and the tension of an elevating cable on the ground to be scooped out. In unquiet water, however, the floating body with the ladder attached thereto will heave on the waves. As a result the pressure exerted by the cutting head on the ground will vary. Moreover, the position of the cutting head will change with respect to the predetermined path. Briefly, the known cutting-head suction-dredger does not allow satisfactory dredging operations in unquiet water, whilst a risk of damage of the dredger is involved.

The invention has for its object to enable effective dredging operations even in unquiet water. The cutting-head suction-dredger of the kind set forth according to the invention is characterized in that the top end of the ladder bears against the floating body by way of the bearing means comprising a rail guide extending substantially in the direction of length of the ladder and being adapted to tilt with respect to the floating body and guide members adapted to move along the rail guide. According to the invention the bottom end of the ladder with the cutting head remains in substantially the same position on the ground whilst the floating body is moving up and down and/or forwards and backwards.

The aforesaid and further features of the invention will be described more fully hereinafter with reference to a drawing showing a number of embodiments of a cutting-head suction-dredger in accordance with the invention.

In the drawing there is shown by way of example in

Figure 2:
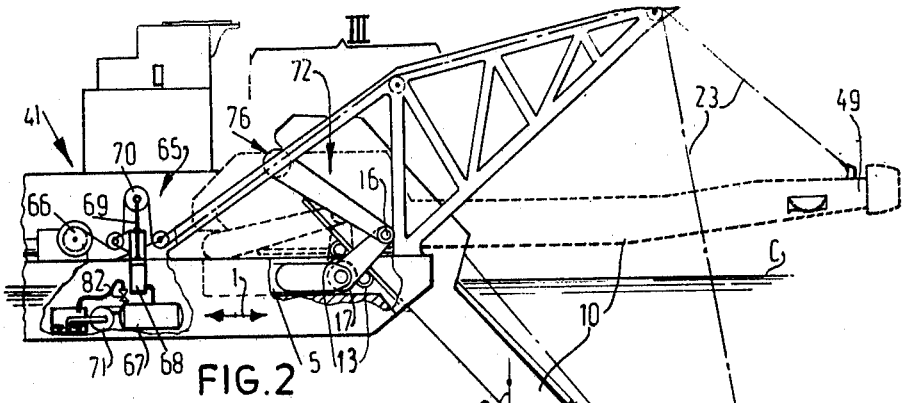
Figure 4:
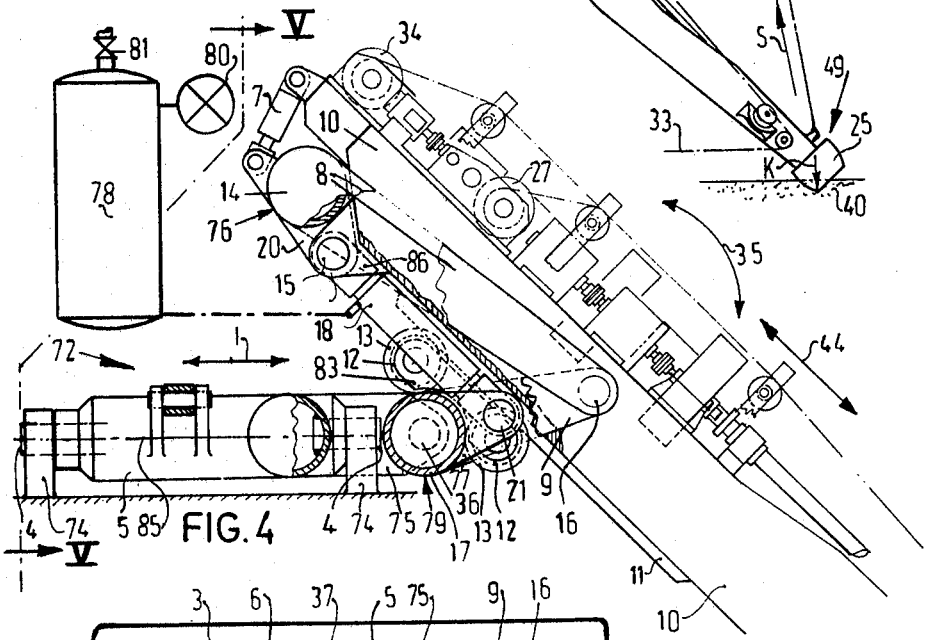
Figure 3:
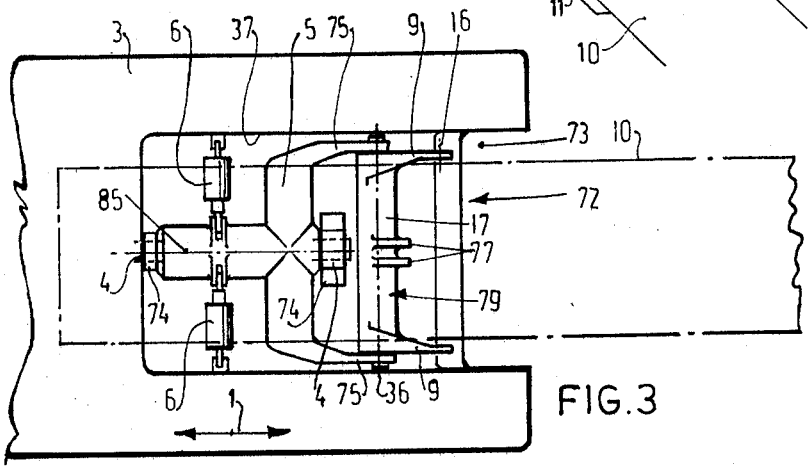
Figure 8:
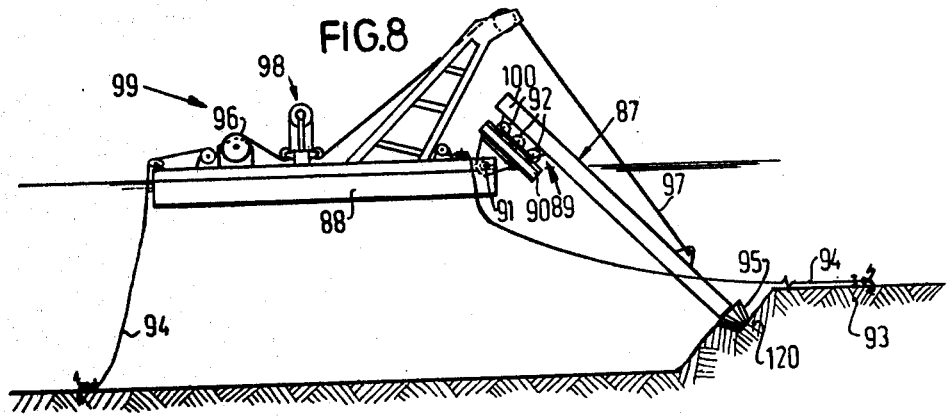
Figure 9:
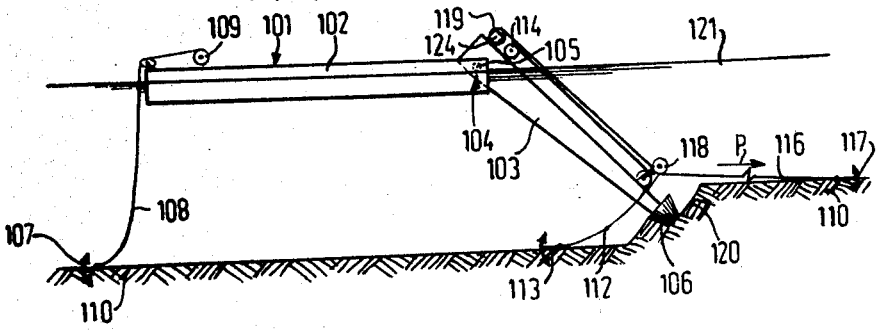
Figure 10:
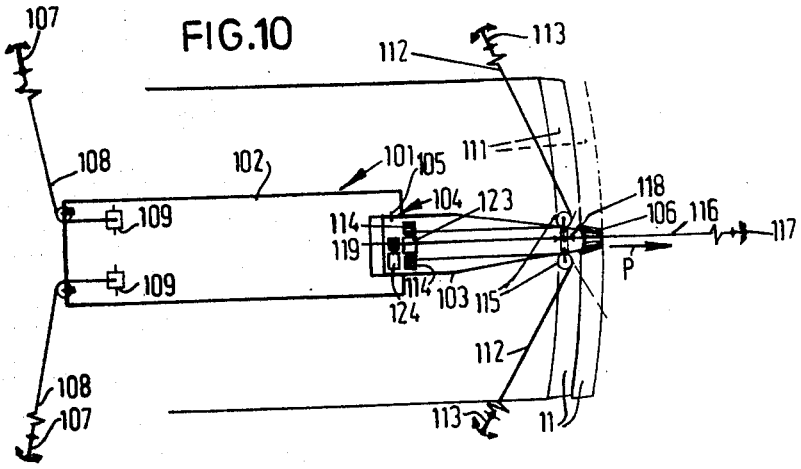

FIG. 1 a perspective, schematic view of a cutting-head suction-dredger embodying the invention, FIG. 2 an enlarged side elevation of the foremost part of the cutting-head suction-dredger embodying the invention in quiet water, FIG. 3 an enlarged plan view of a detail III of FIG. 2 the ladder being omitted, FIG. 4 is an enlarged side elevation of the detail of FIG. 3, FIG. 5 a sectional view taken on the line V—V in FIG. 3, the ladder being in a different position, FIG. 6 a side elevation like that of FIG. 2, the cutting-head suction-dredger being in unquiet water i.e. in a wave-trough and on a wave-crest respectively, FIG. 7 a plan view of the ladder of the cutting-head suction-dredger shown in FIGS. 1 to 6, FIGS. 8 and 9 a schematic side elevation of variants of a cutting-head suction-dredger embodying the invention, and FIG. 10 a plan view of the cutting-head suction-dredger shown in FIG. 9.

Referring to FIGS. 1 and 2, the earth is scooped out by means of a preferred embodiment of a cutting-head suction-dredger 41, a floating body 3 of which is positioned relatively to the bottom 40 by means of anchors 30 and cables 31 of winches 42 on board the floating body 3. The top end 43 of a ladder 10 holding a cutting head 25 is pivotally journalled on the floating body 3. During rolling movements of the floating body 3 this body 3 is allowed to move relatively to the top end 43 in the direction of length of the ladder 10 as indicated by the arrows 44. The floating body 3 is furthermore allowed to perform a rolling movement relative to the top end 43 under said conditions, as indicated by the arrows 45. During the dredging operations the cutting head 25 is moved along a predetermined path 46 across the ground 40, independently of the heaving motions of the floating body 3 by means of side cables 32 of winches 27 on the ladder 10, said cables 32 being connected with anchors 2, the cutting-head suction-dredger 41 swinging about an anchor 47, to which the ladder 10 is secured by means of a longitudinal cable 33 extending in this embodiment to the rear and by means of a winch 34 arranged on the ladder 10.

Referring to FIG. 7, the cutting head 25 is rotatably journalled at the lower end 49 of the ladder 10 in a bearing 48 and it is driven by way of a universal joint shaft 50 and a driving gear 52 by two electric motors 51, arranged one after the other. The top end 43 constantly remains above the water. A suction pipe 54 including a suction nozzle 53 communicates with a pump 55 disposed, for example, at a depth of 8 meters below the surface during the dredging operations and driven via a shaft 56 and a driving gear 57 by two electric motors 58, arranged one after the other. The side cables 32 extend from winches 27 driven by motors 59 along guide discs 60 and along reversing pulleys 61 arranged at the lower end of the ladder 10 towards anchors 2. A longitudinal cable 33 extends from a winch 34 driven by a motor 62 along guide pulleys 63 and a reversing pulley 64 at the lower end of the ladder 10 to the rear towards the anchor 47. In the position indicated by broken lines in FIG. 2 the lower end 49 of the ladder 10 is lifted by means of a lifting cable 23, which is connected with the winch 66 through a cable-length changing gear 65. The cable-length changing gear 65 comprises a hydraulic cylinder 68, a piston rod 69 of which holds a guide pulley 70, and a pressure vessel 67 communicating with the cylinder 68, the pressure of said vessel being adjustable by means of a pump 71 and a valve 82. During the dredging operations the bearing pressure K of the cutting head 25 on the ground 40 depends upon the weight G of the ladder 10 and upon the tension S of the hoisting cable 23. By adjusting the pressure in the pressure vessel 67 the tension of the hoisting cable 23 is set in order to regulate the bearing pressure K of the cutting head 25. During the rolling movements of the floating body 3 the tension of the hoisting cable 23 and hence the bearing pressure K remain substantially constant.

According to the invention the cutting-head suction-dredger 41 is characterized by bearing means 72 shown in FIGS. 3 to 5. The front 73 of the floating body 3 holds a fork 5 extending in the direction of length of the ship and journalled by means of stub shafts 4 in bearings 74. Between the prongs 75 of the fork 5 a U-shaped support 79 is pivotally journalled about a horizontal pivotal axis 36. The support 79 comprises a torsion-resistant tube 17, two ears 77 and two arms 9 welded to the tube 17 and connected with a U-shaped support 76 so as to be pivotable about horizontal stub shafts 16, said support 76 comprising a torsion-resistant tube 14, two arms 8 welded thereto and ears 20 and 86 welded to the latter. The support 76 is connected with ears 24 of the ladder 10 by means of the ears 20 so as to be pivotable about horizontal stub shafts 15. Moreover, the support 76 is connected with the ladder 10 through a pneumatic spring 7. A pneumatic spring 18 is arranged between a horizontal stub shaft 15 of the ears 86 of the support 76 and a horizontal stub shaft 21 of ears 77 of the support 79. The pneumatic spring 18 communicates with a pneumatic vessel 78. The pressure in the vessel 78 is adjustable by means of a compressor 80 and a valve 81. A carriage 83 bears by wheels 13 on the tube 17 of the support 79. The carriage 83 holds supporting rollers 12 and guide rollers 28 adapted to rotate independently of the wheels 13 for guiding the rails 11 arranged on the ladder 10. With respect to the ladder 10 the floating body 3 is capable of moving in the direction of length of the ladder 10 as indicated by the arrows 44, the ladder 10 then moving along the supporting rollers 12 of the carriage 83 by its rails 11.

The torsion-resistant supports 76 and 79 transfer the external, transverse forces exerted on the ladder 10 to the floating body 3. The floating body 3 absorbs part of the weight G of the ladder 10 through the pneumatic spring 18, that is to say, in dependence upon the adjusted pressure of the vessel 78. Consequently the applied pressure K of the cutting head 25 can be controlled also in accordance with the pressure of the air vessel 78. The pneumatic spring 18 compensates for the heaving movements of the floating body 3 and urges the ladder 10 with respect to the floating body 3 towards the position indicated by solid lines in FIG. 2.

When heaving the floating body 3 can move in its direction of length 1, the ladder 10 then performing a swinging movement in the direction of the arrows 35. The wheels 13 then roll along the tube 17. The air spring 7 holds the ladder 10 via the carriage 83 on the tube 17. With respect to the ladder 10 the floating body 3 can perform a rolling motion in the direction of the arrows 45 because the fork 5 can swing about its centre line 85. Pneumatic springs 6 are provided between the fork 5 and the walls 37 and urge the fork 5 into a media position. The pneumatic springs 6 communicate with an individual pneumatic vessel 38, the pressure of which is adjustable by means of a compressor 39 and a valve 84. The pneumatic springs 6 transfer the torsional movement of the cutting head 25 to the floating body 3.

In the position indicated in FIG. 6 by broken lines the floating body 3 is in a wave-trough A, the level difference *q* being, for example, 3 ms below the neutral water level C. The distance *a* of the centre line 36 from the cutting head 25 is at a minimum. The dredge pipe 26 communicates through a flexible section 29 with a pump 19 arranged in the floating body 3, the section 29 having a length such that it allows a relative displacement in the direction of the arrows 44. In the position shown in FIG. 6 by solid lines the floating body 3 is at a wave-crest B, the level difference *t* being, for example, 3 ms above the neutral water level C, the distance *b* between the centre line 36 and the cutting head 25 being at a maximum. During a movement of the floating body 3 between the two positions shown in FIG. 6 the ladder 10 turns through an angle *d*, whereas the cutting head 25 substantially maintains the same position.

Referring to the cutting-head suction dredger 99 shown in FIG. 8, the top end 100 of a rigid ladder 87 bears on the floating body 88 through bearing means 89. These bearing means 89 comprise a rail guide 90, extending substantially in the direction of length of the ladder 87 and adapted to tilt about a hinge 91 with respect to the floating body 88 and guide means 92 adapted to move along the rail guide 90. The guide means 92 are formed by rollers journalled on the ladder 87. During the dredging operations the floating body 88 is anchored with respect to the ground 93 by means of anchoring members 94, whilst the cutting head 95 works the ground 93 and the ladder 87 is maintained at the required depth with the aid of a cable 97 passing along a winch 96 and a compensator 98 for the undulatory motions and including hoisting means.

The cutting-head suction-dredger 101 shown in FIGS. 9 and 10 comprises a floating body 102 and a ladder 103, which is pivotally connected with the floating body 102 through a pivotal joint 104 having a horizontal centre line 105. The ladder 103 has a cutting head 106 at its lower end. The floating body 102 is positioned relatively to the ground 110 by means of anchors 107, anchor cables 108 and winches 109. The cutting head 106 is displaced along the ground 110 on a predetermined path 111 by means of anchor cables 112, which pass via the anchors 113 and reversing pulleys 115 at the lower end of the ladder 103 to winches 114, arranged at the top end 122 of the ladder 103 above the water 121 and driven by electric motors 123 disposed in close proximity and hence in dry and accessible environments. In order to displace the cutting head 106 along the path 111 the winches 114 are driven in opposite senses. According to the invention the cutting head 106 is controlled by means of said anchor cables 112 and a third anchor cable 116, which extends in the direction of length of the ship forwardly away from the ladder 103 as far as beyond the cutting head 106 towards an anchor 117. The anchor cable 116 passes along a reversing pulley 118 at the lower end of the ladder 103 towards a winch 119, which is disposed together with its electric motor 124 at the dry top end of the ladder 103. The anchor cable 116 draws the cutting head 106 with a great force P in the forward direction against the ground 120 to be scooped out.

What we claim is:

1. A cutting-head suction-dredger comprising a floating body, anchoring means for anchoring the floating body, bearing means connecting said ladder with the floating body for allowing said ladder to pivot relative to said body about an axis transverse of said body and to allow said ladder to shift back and forth longitudinally relative to said body, said ladder being rigid from its top end above the water to the lower end, and a cutting head rotatably driven and journalled at the lower end of the ladder, the bearing means comprising a rail guide extending substantially in the direction of length of the ladder and being adapted to pivot with respect to the floating body about said transverse axis and guide members adapted to move along the rail guide.

2. A cutting-head suction-dredger as claimed in claim 1 wherein said rail guide is rigidly secured to the ladder.

3. A cutting-head suction-dredger as claimed in claim 1 wherein the bearing means includes pivot means which permits a relative rolling motion of the floating body about an axis extending longitudinally thereof with respect to the top end of the ladder.

4. A cutting-head suction-dredger as claimed in claim 3 wherein said pivot means comprises a fork adapted to swing about the longitudinal centre line of the floating body.

5. A cutting-head suction-dredger as claimed in claim 4 including two relatively pivotable, torsion-resistant supports connecting said ladder to said fork.

6. A cutting-head suction-dredger as claimed in claim 1 including a pair of winches mounted on said ladder, each winch having a side cable associated therewith for displacing the cutting head during the dredging operations.

7. A cutting-head suction-dredger as claimed in claim 1 including at least one winch on said ladder and a longitudinal cable associated therewith for positioning the ladder relatively to the ground.

8. A cutting-head suction-dredger as claimed in claim 1 including spring means connecting said bearing means with said ladder for compensating the heaving motions of the floating body.

9. A cutting-head suction dredger as claimed in claim 1 wherein said bearing means comprises a tube, a carriage having wheels bearing on the tube and rollers guiding the carriage with respect to the rail guide.

10. A suction dredger assembly comprising, in combination:

an elongate hull provided with anchoring means for controlling movement of said hull during a dredging operation;

a rigid, elongate ladder including a rotatable cutting head carried at one end of the ladder;

mounting means supporting that end of the ladder opposite said cutting head at one end of said hull, said mounting means being slidably and pivotally connected to said hull for allowing said ladder to pivot about an axis transverse to the hull and to shift back and forth longitudinally relative to the hull in response to vertical motions of said hull, said mounting means comprising a rail guide extending substantially in the direction of length of the ladder and being adapted to pivot with respect to said hull about said transverse axis and guide members adapted to move along the rail guide; and force exerting means for causing said cutting head to bear against the bottom below the body of water with predetermined force whereby said vertical motions of the hull cause said ladder to pivot and shift while substantially maintaining said predetermined force.

11. A suction dredger assembly comprising, in combination:

an elongate hull provided with anchoring means for controlling movement of said hull during a dredging operation;

a rigid, elongate ladder including a rotatable cutting head carried at one end of the ladder;

mounting means supporting that end of the ladder opposite said cutting head at one end of said hull for allowing said ladder to pivot about an axis transverse to the hull and to shift back and forth longitudinally relative to the hull in response to vertical motions of said hull; and force exerting means for causing said cutting head to bear against the bottom below the body of water with predetermined force whereby said vertical motions of the hull cause said ladder to pivot and shift while substantially maintaining said predetermined force;

said mounting means including a tube disposed transversely of said hull, a wheeled carriage saddled on said tube, guide rails extending longitudinally on said ladder, and guide means on said carriage engaging said guide rails.

12. A suction dredger as defined in claim 11 wherein said mounting means also includes pivot means mounting said tube for pivotal motion about an axis extending longitudinally of the hull.

13. A suction dredger assembly comprising, in combination:

an elongate hull provided with anchoring means for controlling movement of said hull during a dredging operation;

a rigid, elongate ladder including a rotatable cutting head carried at one end of the ladder;

mounting means supporting that end of the ladder opposite said cutting head at one end of said hull for allowing said ladder to pivot about an axis transverse to the hull and to shift back and forth longitudinally relative to the hull in response to vertical motions of said hull; and force exerting means for causing said cutting head to bear against the bottom below the body of water with predetermined force whereby said vertical motions of the hull cause said ladder to pivot and shift while substantially maintaining said predetermined force;

said mounting means including a tube disposed transversely of said hull, said tube having a radially projecting ear, and said force exerting means comprising spring means acting between said ear and said ladder for resisting downward motion of said ladder.

14. A suction dredger as defined in claim 13 including bearing means on said hull rotatably mounting said tube about its axis.

* * * * *